US011597628B2

(12) United States Patent
Jia et al.

(10) Patent No.: US 11,597,628 B2
(45) Date of Patent: Mar. 7, 2023

(54) SYSTEMS AND METHODS FOR IMPROVED ELEVATOR SCHEDULING

(71) Applicant: Otis Elevator Company, Farmington, CT (US)

(72) Inventors: Zhen Jia, Shanghai (CN); Hui Fang, Shanghai (CN); Arthur Hsu, South Glastonbury, CT (US); Alan Matthew Finn, Hebron, CT (US); Luca F. Bertuccelli, Burlington, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 944 days.

(21) Appl. No.: 16/433,502

(22) Filed: Jun. 6, 2019

(65) Prior Publication Data

US 2019/0389689 A1 Dec. 26, 2019

(30) Foreign Application Priority Data

Jun. 25, 2018 (CN) ..... 201810660825.4

(51) Int. Cl.
*B66B 1/24* (2006.01)
*B66B 1/28* (2006.01)
(Continued)

(52) U.S. Cl.
CPC ..... *B66B 1/2458* (2013.01); *B66B 1/28* (2013.01); *B66B 1/468* (2013.01); *B66B 5/0012* (2013.01);
(Continued)

(58) Field of Classification Search
CPC ..... B66B 1/468; B66B 2201/4653; B66B 2201/4615; B66B 1/2408; B66B 1/3461;
(Continued)

(56) References Cited

U.S. PATENT DOCUMENTS 6,945,365 B2 9/2005 Matela
7,281,610 B2 10/2007 Ylinen et al.
(Continued)

FOREIGN PATENT DOCUMENTS

CN 104968592 A 10/2015
CN 105722780 A 6/2016
(Continued)

OTHER PUBLICATIONS

Mitsubishi Electric Group Control System; Elevator Supervisory System; EAI-2200C Artificial Intelligence System; Internet; URL: https://www.mitsubishielevator.com/images/uploads/documents/pdf/elevators/highspeed/Al200C.pdf; 6 pages.
(Continued)

*Primary Examiner* — Marlon T Fletcher
(74) *Attorney, Agent, or Firm* — Cantor Colburn LLP

(57) ABSTRACT

Methods and systems for controlling elevator systems are provided. The methods include receiving inputs from at least one interactive input device, wherein the inputs include elevator call requests, tracking one or more people located within a monitored area using at least one sensor, assigning elevator assignments to the one or more people based on at least one of the inputs from the at least one interactive input device and a grouping algorithm based on the tracking of the one or more people, and scheduling operation of at least one elevator car based on the elevator assignments.

20 Claims, 9 Drawing Sheets

(51) Int. Cl.
*B66B 1/46* (2006.01)
*B66B 5/00* (2006.01)

(52) U.S. Cl.
CPC ..... *B66B 2201/20* (2013.01); *B66B 2201/223* (2013.01); *B66B 2201/463* (2013.01); *B66B 2201/4653* (2013.01)

(58) Field of Classification Search
CPC ..... B66B 5/0012; B66B 2201/4638; B66B 2201/103; B66B 2201/222; B66B 3/02; B66B 2201/102; B66B 5/0006; B66B 1/34; B66B 2201/223
See application file for complete search history.

(56) References Cited

U.S. PATENT DOCUMENTS

| | | | | |
|---|---|---|---|---|
| 8,260,042 | B2 | 9/2012 | Peng et al. | |
| 8,584,811 | B2 | 11/2013 | Kuoppala et al. | |
| 8,960,373 | B2 | 2/2015 | De Vincentis | |
| 9,079,751 | B2 | 7/2015 | Sundholm et al. | |
| 9,815,664 | B2 | 11/2017 | Zhang et al. | |
| 9,856,107 | B2 | 1/2018 | Haipus et al. | |
| 10,197,401 | B1 * | 2/2019 | Hsu | G09F 19/22 |
| 2012/0020518 | A1 | 1/2012 | Taguchi | |
| 2016/0031675 | A1 | 2/2016 | Silvennoinen et al. | |
| 2016/0251198 | A1 | 9/2016 | Salmikuukka et al. | |
| 2016/0292515 | A1 | 10/2016 | Jia et al. | |
| 2016/0292522 | A1 | 10/2016 | Chen et al. | |
| 2016/0340148 | A1 | 11/2016 | Salmikuukka et al. | |
| 2016/0347577 | A1 | 12/2016 | Simcik et al. | |
| 2016/0368732 | A1 | 12/2016 | Zhao et al. | |
| 2017/0291792 | A1 | 10/2017 | Scoville et al. | |
| 2017/0320702 | A1 | 11/2017 | Gerstenmeyer et al. | |
| 2017/0327344 | A1 | 11/2017 | Richmond et al. | |
| 2017/0355557 | A1 * | 12/2017 | Witczak | B66B 3/008 |
| 2018/0052519 | A1 * | 2/2018 | Amores-Llopis | H04L 67/12 |
| 2019/0382235 | A1 * | 12/2019 | Pahlke | B66B 1/3461 |
| 2019/0389689 | A1 * | 12/2019 | Jia | B66B 1/28 |
| 2020/0130987 | A1 * | 4/2020 | Scoville | B66B 1/468 |
| 2021/0087015 | A1 * | 3/2021 | Gou | B66B 5/24 |

FOREIGN PATENT DOCUMENTS

| | | | | |
|---|---|---|---|---|
| CN | 106144797 | A * | 11/2016 | B66B 1/2408 |
| CN | 106144798 | A * | 11/2016 | B66B 1/2408 |
| CN | 106335822 | A * | 1/2017 | B66B 1/2408 |
| CN | 106429657 | A * | 2/2017 | B66B 1/06 |
| CN | 107337032 | A * | 11/2017 | B66B 1/06 |
| CN | 108975109 | A * | 12/2018 | B66B 1/20 |
| WO | WO-2008046173 | A1 * | 4/2008 | B66B 1/468 |
| WO | 2009122002 | A1 | 10/2009 | |
| WO | WO-2015094178 | A1 * | 6/2015 | B66B 1/3461 |
| WO | WO-2016073067 | A1 * | 5/2016 | B66B 1/2408 |
| WO | 2018012044 | A1 | 1/2018 | |

OTHER PUBLICATIONS

European Search Report for European Application No. 19182430.9, International Filing Date Jun. 25, 2019, dated Oct. 25, 2019, 12 pages.
China Office Action dated Apr. 2, 2022; Application No. 201810660825.4 (9 pages).

* cited by examiner

SYSTEMS AND METHODS FOR IMPROVED ELEVATOR SCHEDULING

CROSS REFERENCE TO RELATED APPLICATIONS

This application claims the benefit of China Application No. 201810660825.4, filed Jun. 25, 2018, which is incorporated herein by reference in its entirety.

BACKGROUND

The following description relates to elevator systems and, more specifically, to method and systems for improved elevator dispatching.

Tracking potential users of elevator systems and inputs received therefrom (e.g., elevator call requests) plays an important role in intelligent building technologies. Such technologies can include, but are not limited to, building security and safety technologies, elevator scheduling optimization technologies, and building energy control technologies.

BRIEF DESCRIPTION

According to some embodiments, elevator systems are provided. The elevator systems include an elevator car operable within an elevator shaft and moveable between a plurality of landings, an elevator controller operable to control movement and position of the elevator car within the elevator shaft, and an elevator scheduling system. The elevator scheduling system includes at least one sensor configured to monitor a monitored area, at least one interactive input device configured to receive input from at least one user, and a scheduling controller coupled to the at least one sensor and the at least one interactive input device. The scheduling controller is configured to receive inputs from the at least one interactive input device, track one or more people located within the monitored area, assign elevator assignments to the one or more people based on at least one of the inputs from the at least one interactive input device and a grouping algorithm based on the tracking of the one or more people, and schedule operation of the elevator car based on the elevator assignments.

In accordance with additional or alternative embodiments to the above elevator systems, the systems may include that the at least one interactive input device comprises at least one of a kiosk, a hall call panel, a mobile device, and a key card.

In accordance with additional or alternative embodiments to the above elevator systems, the systems may include that the at least one sensor comprises a 3D depth sensor.

In accordance with additional or alternative embodiments to the above elevator systems, the systems may include that the scheduling controller and the elevator controller are part of the same computing system.

In accordance with additional or alternative embodiments to the above elevator systems, the systems may include that the scheduling controller tracks an individual that does not interact with the at least one interactive input device and assigns the individual an elevator assignment based on the grouping algorithm.

In accordance with additional or alternative embodiments to the above elevator systems, the systems may include that the scheduling controller tracks an individual that interacts with the at least one interactive input device and assigns the individual an elevator assignment based on input at the at least one interactive input device.

In accordance with additional or alternative embodiments to the above elevator systems, the systems may include that the input from the individual is propagated to at least one additional person based on the grouping algorithm.

In accordance with additional or alternative embodiments to the above elevator systems, the systems may include that the grouping algorithm is machine learned.

In accordance with additional or alternative embodiments to the above elevator systems, the systems may include at least one additional elevator car, wherein the elevator assignments indicate which elevator car each person is assigned to.

In accordance with additional or alternative embodiments to the above elevator systems, the systems may include that the monitored area is an elevator lobby.

According to some embodiments, methods for controlling elevator systems are provided. The methods includes receiving inputs from at least one interactive input device, wherein the inputs include elevator call requests, tracking one or more people located within a monitored area using at least one sensor, assigning elevator assignments to the one or more people based on at least one of the inputs from the at least one interactive input device and a grouping algorithm based on the tracking of the one or more people, and scheduling operation of at least one elevator car based on the elevator assignments.

In accordance with additional or alternative embodiments to the above methods, the methods may include that the at least one interactive input device comprises at least one of a kiosk, a hall call panel, a mobile device, and a key card.

In accordance with additional or alternative embodiments to the above methods, the methods may include that the at least one sensor comprises a 3D depth sensor.

In accordance with additional or alternative embodiments to the above methods, the methods may include that the scheduling is performed at a scheduling controller that is part of an elevator controller.

In accordance with additional or alternative embodiments to the above methods, the methods may include tracking an individual that does not interact with the at least one interactive input device and assigning the individual an elevator assignment based on the grouping algorithm.

In accordance with additional or alternative embodiments to the above methods, the methods may include tracking an individual that interacts with the at least one interactive input device and assigning the individual an elevator assignment based on input at the at least one interactive input device.

In accordance with additional or alternative embodiments to the above methods, the methods may include propagating the input from the individual to at least one additional person based on the grouping algorithm.

In accordance with additional or alternative embodiments to the above methods, the methods may include machine learning the grouping algorithm.

In accordance with additional or alternative embodiments to the above methods, the methods may include at least one additional elevator car, wherein the elevator assignments indicate which elevator car each person is assigned to.

In accordance with additional or alternative embodiments to the above methods, the methods may include determining if an input received at an interactive input device is a second input from at least one person of a group of one or more persons and taking corrective action regarding the second input.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

DETAILED DESCRIPTION

Figure 1:
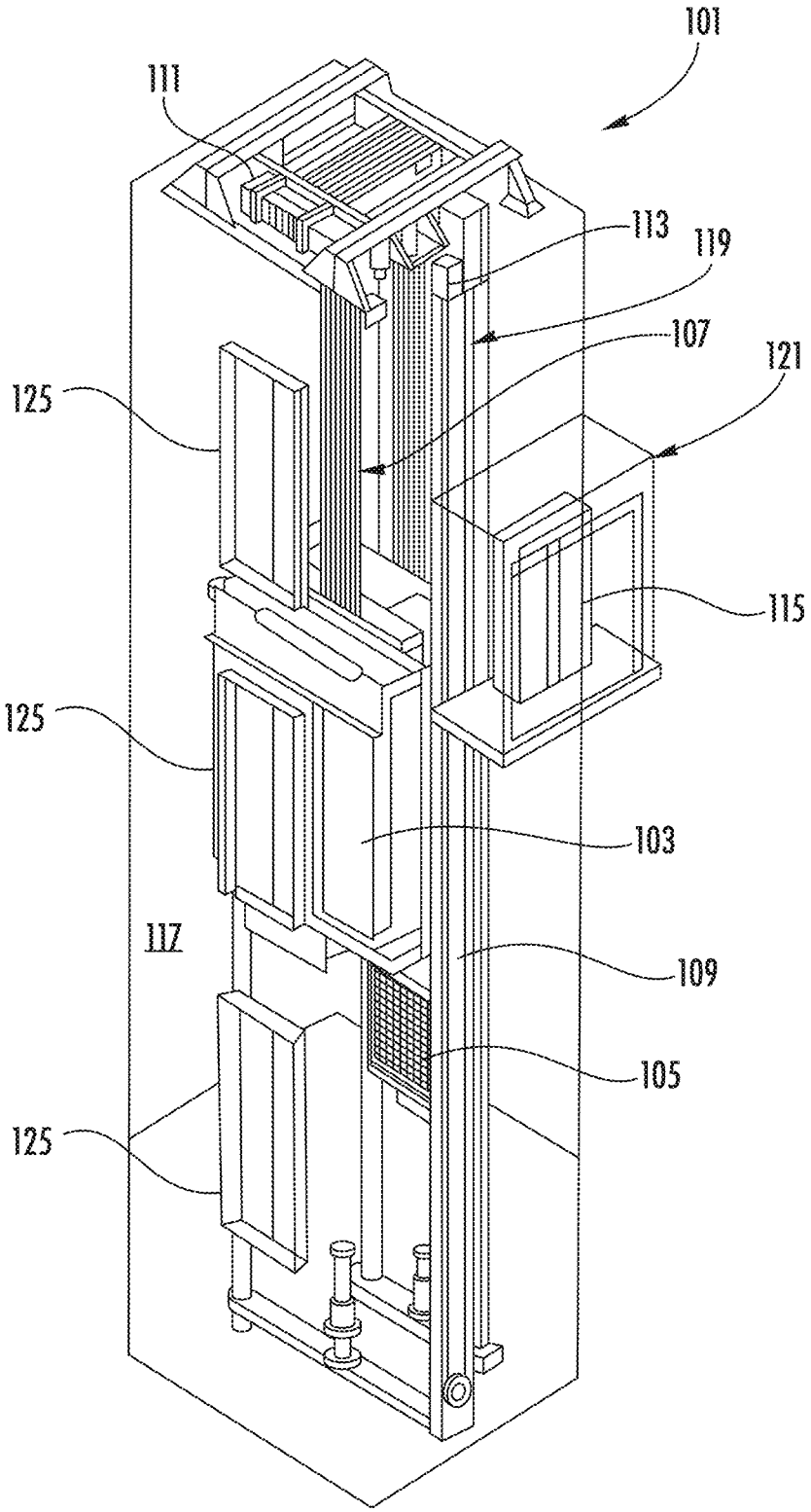
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

As will be appreciated by those of skill in the art, an elevator system may include a plurality of elevator cars that operate within multiple separate elevator shafts (or may operate within a shared elevator shaft). Intelligent building technologies, including advanced elevator scheduling, may receive inputs and requests from users (e.g., passengers) and based on such information determine where elevator cars should be directed and/or stationed when waiting for additional elevator call requests. Embodiments of the present disclosure incorporate a scheduling controller to provide scheduling as described herein. In some embodiments, the scheduling controller may be a separate and distinct element or device that is operably connected to and in communication with an elevator controller. In other embodiments, the elevator controller may incorporate the features of the scheduling controller (e.g., a sub-system, program, application, or sub-routine of the elevator controller). Furthermore, in some embodiments, the scheduling controller may be completely remote from the elevator system, but in communication therewith. For example, in some such embodiments, the sensed and/or collected data as described herein may be transmitted to one or more remote servers (e.g., the "cloud") and processed may be performed remotely. Subsequently, scheduling may be communicated to the elevator controller to prompt control of the elevator system in accordance with scheduling instructions.

Destination management systems may be employed to provide input into an elevator control logic for elevator car scheduling (e.g., to an elevator scheduling controller). Such systems may provide easy to use interfaces for passengers to interact with in order to register hall calls in the lobby (or at other floors of a building). Further, such systems may provide guidelines, instructions, or prompts to guide a passenger to approach the correct elevator for fast and/or efficient boarding. However, with such destination management systems, there are some scenarios where people may intentionally misuse the system, thus reducing efficiencies. For example, one person may enter multiple hall calls at the same time to secure a less crowded elevator, or one or more people may bypass the interactive input devices and go directly to any of the available elevators and board with other people or groups of people. In such instances, the elevator controller (or scheduling controller) cannot properly account for the number of people associated with each call registration at the interactive input device. Sometimes the assigned elevator may not be able to take a group of people if only one person enters a call for multiple persons, or only few people board the assigned elevator where the elevator could take more people at the same time. Accordingly, efficiencies may be improved through embodiments of the present disclosure. For example, embodiments provided herein may employ sensing technologies to detect, track, group, and analyze passenger intent at the lobby or at a given landing within the elevator system.

In operation, a destination management system may organize travel by grouping both passengers and stops. Passengers going to the same destination may be assigned to the same elevator. Moreover, elevators may be assigned to serve a group of floors, or a zone. The result is faster, better-organized service. The passenger assignments may be displayed on a display screen (e.g., at a kiosk) once a passenger inputs a destination into the system. A specific elevator door, or even a specific elevator car, may be assigned so that the passenger knows where to wait and where/when to board the designated elevator car.

In accordance with some embodiments, sensing technologies are incorporated into the destination management system to detect, track, group, and analyze passenger information in the elevator lobby to detect various use cases.

For example, one use case may be referred to as "piggybacking," where a group of people enter the elevator lobby and one or more people out of the group (i.e., a subpart of the group) approach a kiosk and enter a call and then rejoin the group. In such situation, if one person entered a destination, or more than one entered the same destination, the whole group is assigned the elevator boarding information (e.g., floor number and elevator number). Further, if the entered destinations by multiple members of the group are different and the group can be partitioned by intent, as described herein, the subgroups are assigned the corresponding boarding information. If the group cannot be partitioned, each member of the group may be assigned an "unknown" or placeholder value that is not assigned a destination floor or elevator car.

Another form of piggybacking may occur when one or more people enter the lobby and bypass the kiosks entirely, and instead wait at a particular elevator with or without another other group already there. That is, this person or group bypasses the interactive input devices entirely and merely goes straight to the elevators, and wait for an elevator called by another person or one that is delivering passengers to the given floor (e.g., to the lobby and exiting the elevator car). In such instance, if there are existing groups, the newly joined people are assigned the elevator boarding information of the exiting group (elevator number and floor number). However, if there are no current existing group(s) or there are multiple groups, the new people may be assigned the "unknown" status.

It will be appreciated that an unknown status passenger may be accounted for with scheduling, and thus such information is beneficial, even if not all possible information is available. For example, if an unknown status passenger is waiting at a given position, the destination management system may assign the passenger with worst-case information, such as traveling to the highest floor of a given elevator, and thus being in the elevator car for the duration of a given travel.

Figure 2:
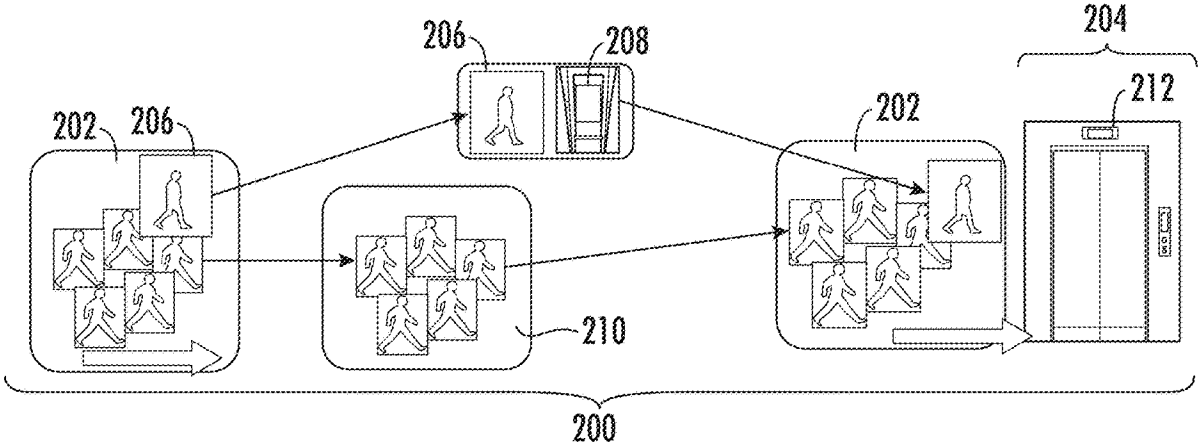
FIG. 2 is a schematic illustration of a first use case illustrating use of an elevator system.
Figure 3:
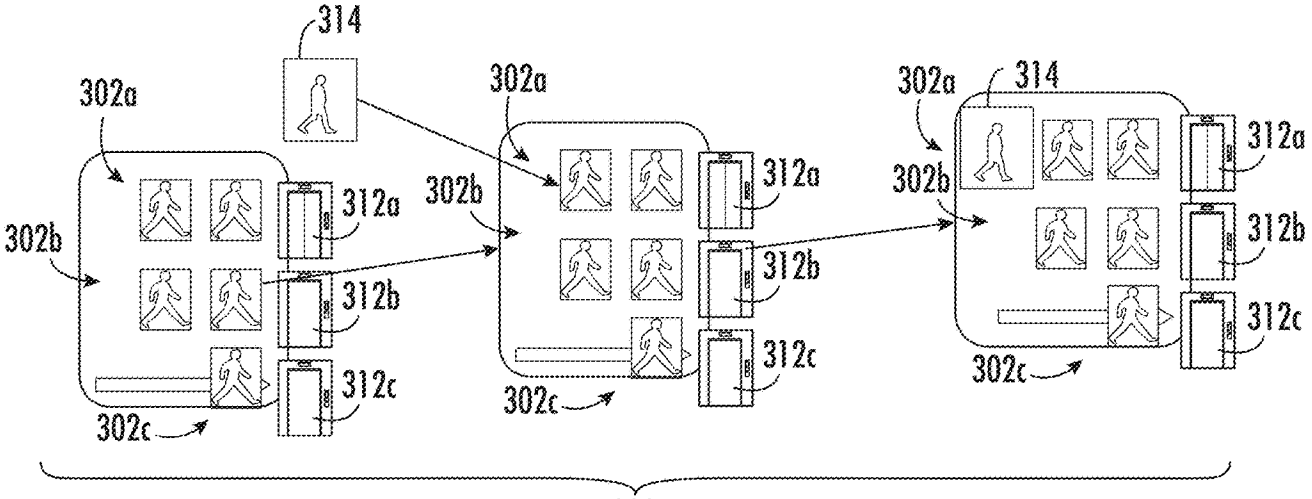
FIG. 3 is a schematic illustration of a second use case illustrating use of an elevator system.

Turning now to FIGS. 2-3, use cases 200, 300 are shown, respectively. The use cases 200, 300 are schematic illustrations of group dynamics when calling elevators for traveling within a building. FIG. 2 illustrates a use case 200 that represents the first above-described piggybacking scenario and FIG. 3 illustrates a use case 300 that represents the second above-described piggybacking scenario.

In the first use case 200, as shown in FIG. 2, a group 202 is detected approaching an elevator system 204. A member 206 of the group 202 separates from the group 202 and approaches an interactive input device 208, such as a kiosk, to input a destination. The remainder 210 of the group 202 bypasses the interactive input device 208 and heads straight to the elevator system 204. After placing an elevator request at the interactive input device 208, the member 206 returns to the remainder 210 to reform the entire original group 202. The group 202 may then wait at a designated elevator door 212 to travel to the destination entered by the member 206 at the interactive input device 208. In such situations, an elevator controller and/or scheduling controller will receive only a single input from a single passenger (the member 206) and will not have information regarding the remainder 210 of the group 202 (e.g., unknown number of additional passengers). Thus, when performing a scheduling operation, the system may only account for a single passenger associated with the input destination.

In the second use case 300, as shown in FIG. 3, a first group of passengers 302*a* is already assigned to board an elevator car at a first elevator door 312*a*, and thus is waiting at the first elevator door 312*a*. Similarly, a second group of passengers 302*b* is assigned to board an elevator car at a second elevator door 312*b*, and thus is waiting at the second elevator door 312*b*, and a third group of passengers 302*c* is assigned to board an elevator car at a third elevator door 312*c*, and thus is waiting at the third elevator door 312*c*. However, as shown, an additional passenger 314 is shown joining the first group of passengers 302*a*, but the additional passenger 314 has bypassed any interactive input devices and thus the destination of such passenger (or existence thereof) is not input into the system. Such situations may occur when the additional passenger 314 recognizes the members of the first group of passengers 302*a* and knows that such passengers will be going to the same destination, and thus an entry into the interactive input device may not be required. In such situations, an elevator controller and/or scheduling controller will receive only the input(s) from the passengers of the groups 302*a*, 302*b*, 302*c* and will not have information regarding the additional passenger 314 (e.g., unknown number of additional passengers). Thus, when performing a scheduling operation, the system may only account for only those passenger associated with the groups 302*a*, 302*b*, 302*c*, and not any additional passengers that bypass the interactive input devices.

In accordance with embodiments of the present disclosure, the use cases 200, 300 may be accounted for to enable efficient elevator scheduling. For example, For the first use case 200, with detection, grouping, and tracking information, the system may estimate the number of people that intend to board the same assigned elevator and if the number of people is too large (or too small), the system may make adjustments to the elevator scheduling. Further, for the second use case 300, the system may estimate the number of people that intend to board elevators, even if a number of the people do not have assignments issued by an interactive input device. Based on this, the system may make appropriate adjustments to the elevator scheduling.

In accordance with embodiments of the present disclosure, an elevator control system combines data obtained from interactive input devices (e.g., user inputs for elevator call requests) with analytical data associated with tracking and group dynamics in order to more efficiently schedule elevator operation. Embodiments of the present disclosure may be implemented within an elevator controller (as a scheduling controller), in a discrete or separate scheduling controller, and/or in a remote scheduling controller (e.g., remote control system and/or cloud-based).

As used herein, the term user input refers to input received at an interactive input device (such as a kiosk), at hall call panels, at a receiver that receives requests from user devices (such as mobile devices, key cards, etc.), and the like. The user input typically includes at least a destination request input into the elevator system by any means. In some embodiments, the user input may include user identifying and/or authorizing information.

The term group information refers to data collected by one or more sensors and analyzed based on group dynamics. The group information is extracted or generated from sensor data obtained at one or more sensors. Group information may be analytically determined based on the sensor input, such as people detection and people tracking. For example, group information may be obtained using pedestrian tracking systems as known in the art. Analysis of a given detected person or persons can be used to generate group dynamic information including a statistical determination of an intent of a tracked or detected person.

The term state information refers to data assigned to a given detected individual with respect to assignments and elevator scheduling, which may be based on the user input and/or the group information. The state information may be an assignment to a specific elevator (e.g., elevator door or even elevator car) or may be unknown, when the data is insufficient to determine a destination of a specific person or group of persons. That is, the state information including tracking, grouping, intent, authorization, and elevator assignment may be definitive (e.g., based on user input), may be partially or completely inferred, or may be unknown. However, in some embodiments, the system will maintain the state information probabilistically and may resolve the probabilities by comparison to thresholds when a definitive solution is required for decision making.

As provided herein, embodiments of the present disclosure employ 3D depth sensing to detect and track each individual person in a given area (e.g., an elevator lobby or waiting area) and then using an unsupervised clustering approach to form tracking groups. This approach is merely for example only, and alternative embodiments may use other grouping approaches. Based on the tracked trajectories of each person and the group as a whole, elevator scheduling may be improved.

As noted, in some embodiments, 3D depth sensing technologies are employed to achieve the detection and group information data collection. However, in some embodiments, 2D RGB surveillance cameras may be employed. Other types of sensing technologies that may be incorporated into embodiments of the present disclosure may include, but are not limited to, facial recognition, thermal imaging, indoor localization, etc., as will be appreciated by those of skill in the art. In a 3D depth system, the sensor(s) provide three dimensional information, i.e., the distance between the detected object and the sensor.

Figure 4:
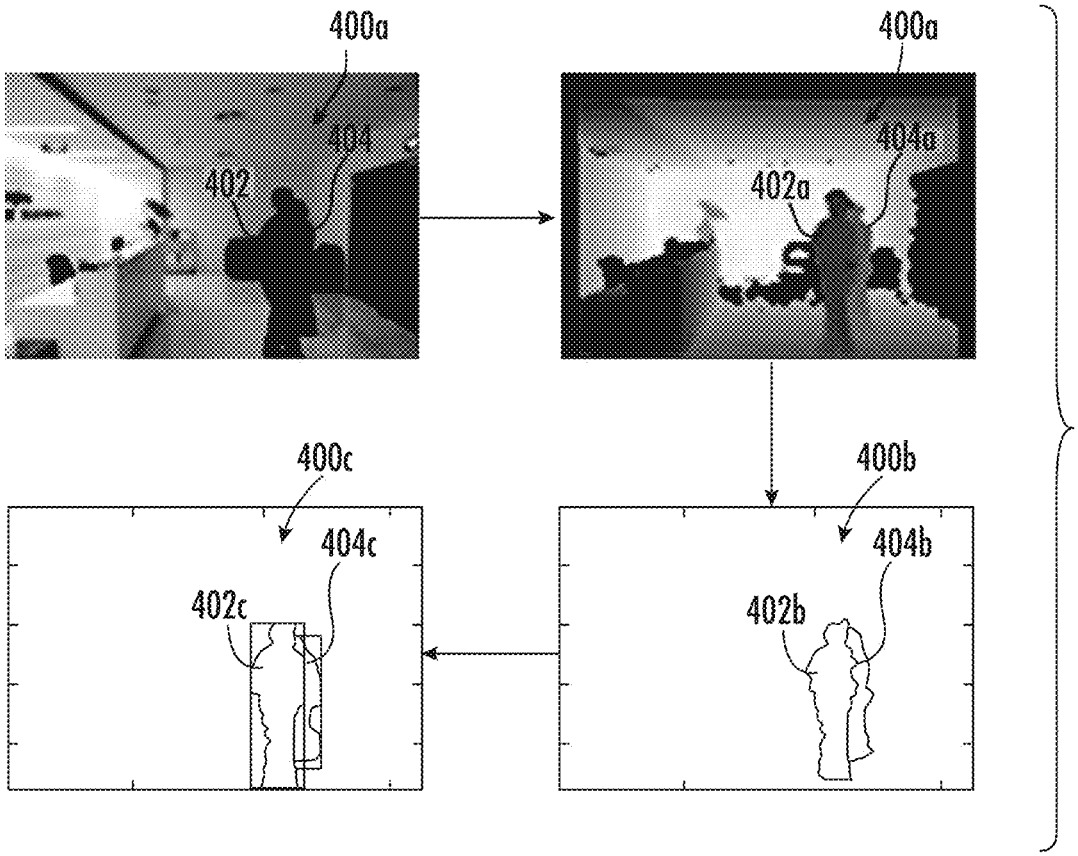
FIG. 4 is a schematic illustration of a monitored area monitored by a sensor in accordance with an embodiment of the present disclosure.

For example, turning to FIG. 4, various illustrations of a monitored area 400 having two people 402, 404 are shown, as viewed by a detector or sensor (e.g., a camera). In the illustrations, digital processing of an image is performed such that a digital space representation 400*a* of the monitored area 400 is shown with a first object 402*a* and a second object 402*b* representative of data associated with a first person 402 and a second person 404. In this example, the positions of the people 402, 404 are such that overlap in a 2D object detection algorithm would not be able to separate the first person 402 from the second person 404. However, depth values obtained from a 3D depth sensor can provide improved detection. In some such embodiments, the first and second persons 402, 404 may be digitally represented as different elements (e.g., by color, texture, pattern, etc.). As shown, in space 400*b*, the first person 402 may be detected and illustratively shown as a first representation 402*b* and the second person 404 may be detected and illustratively shown as a second representation 404*b*, using depth information. The first and second representations 402*b*, 404*b* may be configured into respective discrete objects 402*c*, 404*c* within a space 400*c*. The 3D depth data provides the ability to detect objects (e.g., pedestrians, passengers, etc.) more accurately with more tolerance of occlusion. As will be appreciated by those of skill in the art, 3D data (e.g., 3D sensing, depth sensing) is typically different than 2D data (e.g., camera captures (images, video)).

In 2D imaging, the reflected color (mixture of wavelengths) from a first object in each radial direction from the camera is captured. The resulting image is a 2D projection of the 3D world where each pixel is the combined spectrum of the source illumination and the spectral reflectivity of an object in the scene. As will be appreciated by those of skill in the art, 3D depth sensing typically does not include color (spectral) information. In contrast, with 3D depth sensing, each pixel is a distance (also called depth or range) to a first reflective object in each radial direction from the camera. The data from depth sensing is typically called a depth map or point cloud. 3D data is also sometimes considered as an occupancy grid wherein each point in 3D space is denoted as occupied or not. 2D and 3D imaging/sensing can be combined for various applications, including in embodiments of the present disclosure.

Although, a 2D image cannot be converted into a depth map and a depth map cannot be converted into a 2D image, combinations and processing of the two types of data may be advantageous. For example, in some systems, an artificial assignment of contiguous colors or grayscale to contiguous depths may be applied to enable a depth map to incorporate 2D data (e.g., somewhat akin to how a person sees a 2D image). Advantageously, combining both 2D and 3D data sets enables different physical characteristics to sensed or detected. For example, two adjacent pixels in an image may be the same color or not; two adjacent pixels in a depth map may be at the same range or not. In one such example, the processing of image/sensor data may group spatially adjacent pixels of the same color as belonging to the same object and/or modify such classification based on range data from a depth map. Although described above and here as using 3D depth sensing, embodiments of the present disclosure may be based on 3D depth sensing, 2D image detection, and/or a combination of the two.

In accordance with some non-limiting embodiments of the present disclosure, depth sensor target tracking is performed and a data association method is employed to track the movement of pedestrians across multiple depth sensors. Based on depth sensing target tracking, embodiments provided herein automatically detect and track people in an area of interest, and particularly users of interactive input devices of elevator systems. However, in other embodiments, 2D imaging or other imaging/detection/sensing technologies may be employed, or combinations of various types of imaging/detection/sensing technologies may be employed without departing from the scope of the present disclosure.

Figure 5:
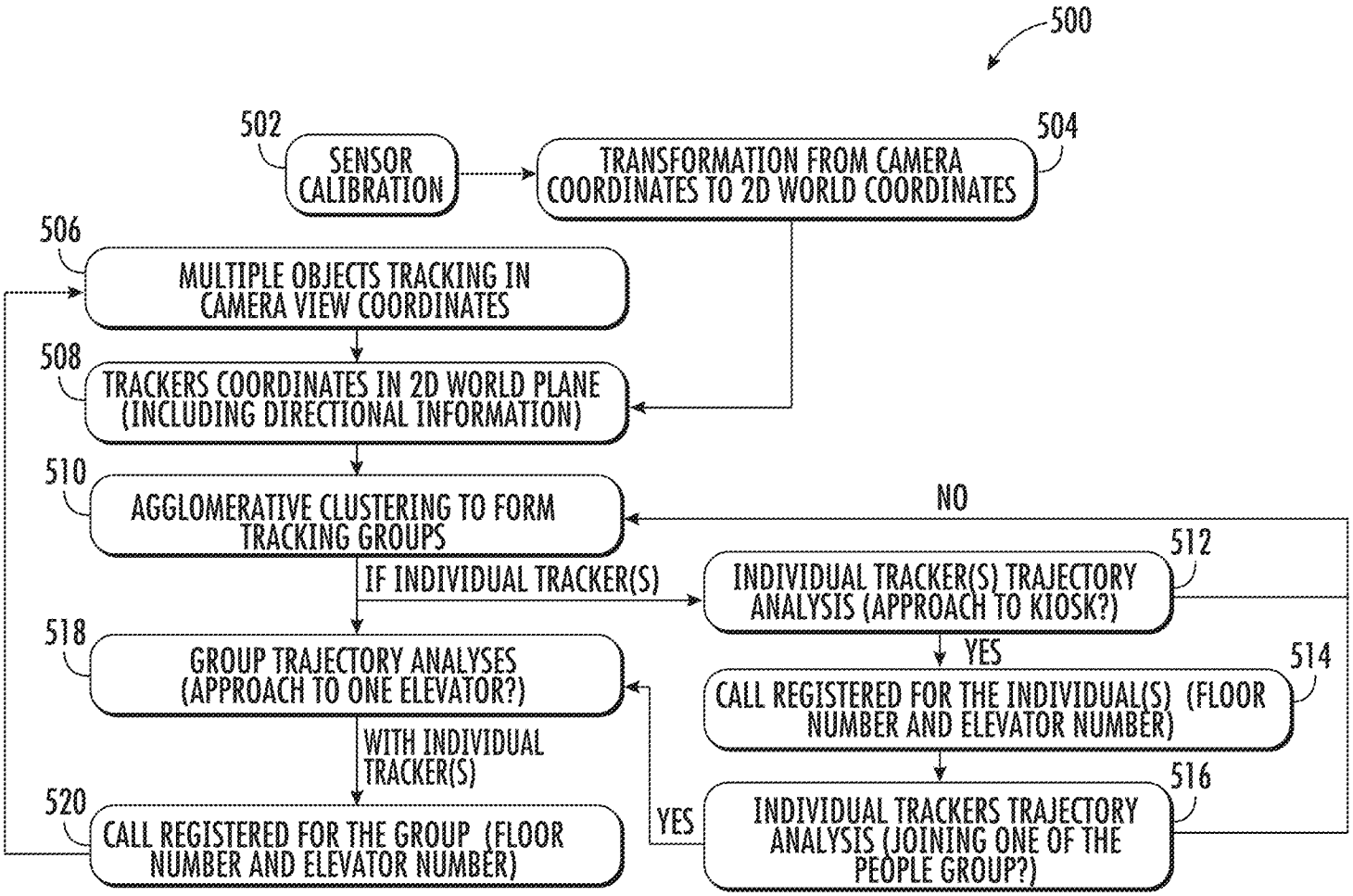
FIG. 5 is a schematic flow process in accordance with the present disclosure for dealing with the first use case.

Turning now to FIG. 5, a flow process 500 for dealing with the first use case described above is schematically shown. The flow process 500 may be performed using an elevator control system having an elevator scheduling routine or process (e.g., as part of an elevator controller or scheduling controller). The elevator control system in accordance with an embodiment of the present disclosure includes one or more interactive input devices (or other means for receiving use input, as described above), one or more sensors, and a computing system arranged to process user input and sensor data. The processing of the user input and sensor data can include determination of assignments for users of an elevator system (e.g., elevator scheduling). Further, the computing system can control an elevator system (e.g., positions of elevator cars within an elevator shaft) and/or communicate with an elevator controller if the computing system is not an integral part thereof.

At block 502, sensor calibration is conducted. At block 504, a computation of image-to-world coordinate transformation matrix is performed. The computing system uses the transformation matrix to obtain the 2D (e.g., floor plane) world coordinate position of tracked objects. During the steps of blocks 502-504, a predetermined monitored space, such as an elevator lobby, elevator waiting area, building lobby, etc. may be determined. The predetermined monitored space is defined by the detectable space of one or more sensors of the system (e.g., 3D depth sensors). Blocks 502-504 may be performed off-line, such as during an initial set-up of the elevator system within a building.

Blocks 506-520 are performed in normal operation and are used to make elevator scheduling decisions. At block 506, the system will track one or more objects within the monitored space. The tracking of block 506 is tracked within a camera view coordinate system. At block 508, the camera view coordinate system data obtained at block 506 is converted into the world coordinate system defined from blocks 502-504. Thus, at blocks 506-508, the system tracks each person in the sensor field of view in 2D (e.g., floor plane) world coordinates.

At block 510, agglomerative clustering is employed to form tracking groups. The tracking groups are groups of multiple distinct or discrete objects (e.g., detected people within the monitored space). The agglomerative clustering is performed to define specific groups of people, and enable tracking of such groups.

If the system is tracking a single individual, the flow process 500 continues to block 512, where the individual is tracked. At block 512, the tracked individual is monitored and a trajectory of movement is determined. If the trajectory indicates that the tracked individual will approach an interactive input device (e.g., a kiosk of the elevator system), then the flow process 500 continues to block 514, otherwise the flow process 500 returns to block 510.

At block 514, the system receives input from the tracked individual at the interactive input device. Thus, at block 514, the system may register an elevator call request for the specific tracked individual (e.g., floor number and elevator number). That is, at block 514, the system assigns elevator car and destination floor to individuals who use the interactive input device (e.g., a destination entry system).

After receiving the user input at the interactive input device at block 514, the tracking of the tracked individual continues at block 516 to determine if the tracked individual joins a group of other people or if they do not. If the tracked individual stays alone, the flow process 500 returns to block 510, otherwise, the flow process continues to block 518. At block 518, group trajectory analyses is performed to determine if groups or subgroups approach a specific or single elevator. Based on the tracking of groups, subgroups, and individuals, at block 520, the system may adjust the assignments for a given elevator.

That is, the system uses hierarchical agglomerative clustering to group the tracks of individuals into groups or subgroups. The system may detect if one or more individuals leave or join a group by analyzing the tracked trajectories. Based on the tracked trajectories, the system may propagate the assignment from one individual (who made input at an interactive input device, e.g., at block 514) to groups or subgroups.

The flow process 500 is a continuous process that monitors people coming and going from a monitored area. Accordingly, as shown, the flow process 500 is a loop, which may be continuously updated as people enter and/or leave the monitored area. As shown, the preliminary steps of blocks 502-504 are not necessarily repeated, and thus the illustrative flow process 500 in FIG. 5 illustrates a loop of blocks 506-520, although other loops and/or cycles of steps and processes may be implemented without departing from the scope of the present disclosure.

Figure 6:
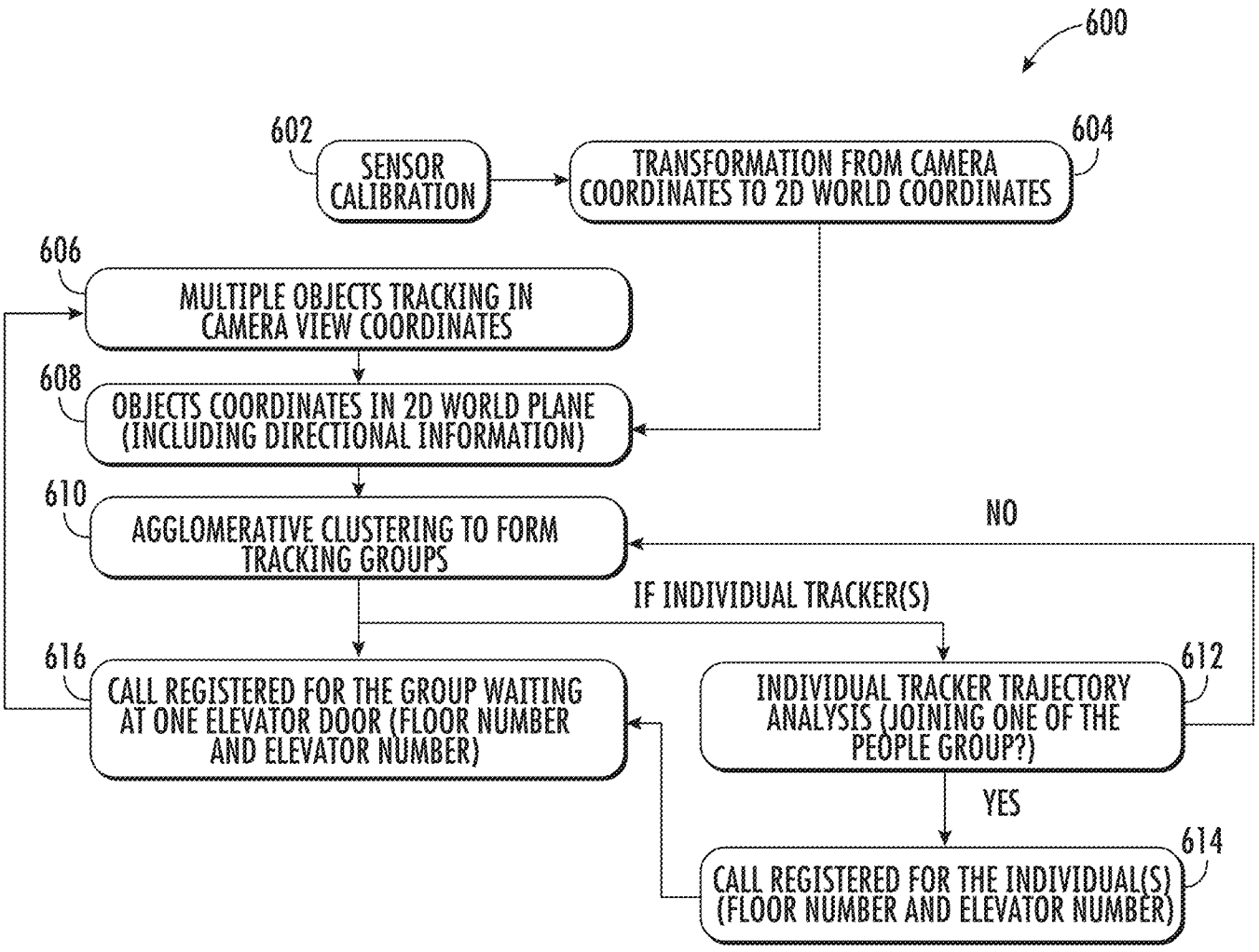
FIG. 6 is a schematic flow process in accordance with the present disclosure for dealing with the second use case.

Turning now to FIG. 6, a flow process 600 for dealing with the second use case described above is schematically shown. The flow process 600 may be performed using an elevator control system having an elevator scheduling routine or process (e.g., as part of an elevator controller or scheduling controller). The elevator control system in accordance with an embodiment of the present disclosure includes one or more interactive input devices (or other means for receiving use input, as described above), one or more sensors, and a computing system arranged to process user input and sensor data. The processing of the user input and sensor data can include determination of assignments for users of an elevator system (e.g., elevator scheduling). Further, the computing system can control an elevator system (e.g., positions of elevator cars within an elevator shaft) and/or communicate with an elevator controller if the computing system is not an integral part thereof.

At block 602, sensor calibration is conducted. At block 604, a computation of image-to-world coordinate transformation matrix is performed. The computing system uses the transformation matrix to obtain the 2D (e.g., floor plane) world coordinate position of tracked objects. During the steps of blocks 602-604, a predetermined monitored space, such as an elevator lobby, elevator waiting area, building lobby, etc. may be determined. The predetermined monitored space is defined by the detectable space of one or more sensors of the system (e.g., 3D depth sensors). Blocks 602-604 may be performed off-line, such as during an initial set-up of the elevator system within a building.

Blocks 606-616 are performed in normal operation and are used to make elevator scheduling decisions. At block 606, the system will track one or more objects within the monitored space. The tracking of block 606 is tracked within a camera view coordinate system. At block 608, the camera view coordinate system data obtained at block 606 is converted into the world coordinate system defined from blocks 602-604. Thus, at blocks 606-608, the system tracks each person in the sensor field of view in 2D (e.g., floor plane) world coordinates.

At block 610, agglomerative clustering is employed to form tracking groups. The tracking groups are groups of multiple distinct or discrete objects (e.g., detected people within the monitored space). The agglomerative clustering is performed to define specific groups of people, and enable tracking of such groups.

If the system is tracking a single individual, the flow process 600 continues to block 612, where the individual is tracked. At block 612, the tracked individual is monitored and a trajectory of movement is determined. If the trajectory indicates that the tracked individual will join with an existing group of people, then the flow process 600 continues to block 614, otherwise the flow process 600 returns to block 610.

At block 614, the system assigns data to the tracked individual based on the group which the individual joins. Thus, at block 614, the system may register an elevator call request for the specific tracked individual (e.g., floor number and elevator number) based on other already-registered individuals. After assigning data to the tracked individual at block 614, at block 616 the system will register a call (or update a call) based on the assignments made at block 614. Accordingly, the system may adjust the assignments for a given elevator even for situation like the second use case described above.

That is, the system uses hierarchical agglomerative clustering to group the tracks of individuals into groups or subgroups. The system may detect if one or more individuals join a group by analyzing the tracked trajectories. Based on the tracked trajectories, the system may propagate the assignment from the group to one or more individuals who did not make an input at an interactive input device.

The flow process 600 is a continuous process that monitors people coming and going from a monitored area. Accordingly, as shown, the flow process 600 is a loop, which may be continuously updated as people enter and/or leave the monitored area. As shown, the preliminary steps of blocks 602-604 are not necessarily repeated, and thus the illustrative flow process 600 in FIG. 6 illustrates a loop of blocks 606-616, although other loops and/or cycles of steps and processes may be implemented without departing from the scope of the present disclosure.

In accordance with some embodiments, the grouping performed in the flow processes described above is based on hierarchical clustering. Hierarchical clustering (also called hierarchical cluster analysis or HCA) is a method of cluster analysis which seeks to build a hierarchy of clusters. Strategies for hierarchical clustering generally fall into two types. A first type of hierarchical clustering is agglomerative clustering. This is a "bottom up" approach where each observation starts in its own cluster, and pairs of clusters are merged as one moves up the hierarchy. A second type of hierarchical clustering is divisive clustering. This is a "top down" approach where all observations start in one cluster, and splits are performed recursively as one moves down the hierarchy.

In accordance with some embodiments, the systems described herein employ hierarchical agglomerative clustering to form linkages between different trackers to form groups. The reason for this selection is because the system cannot know the number of clusters as prior knowledge and the number of cluster may also change from time to time (as people move into and out of groups). For example, sometimes a single cluster may include all the detected people, and sometimes two or more separate groups with different destinations and members may be present. Group definitions may change as members of the groups leave and/or join while located within the monitored space. Hierarchical agglomerative clustering may be used to manage unsupervised clustering problems with dynamically changing cluster numbers.

Figure 7:
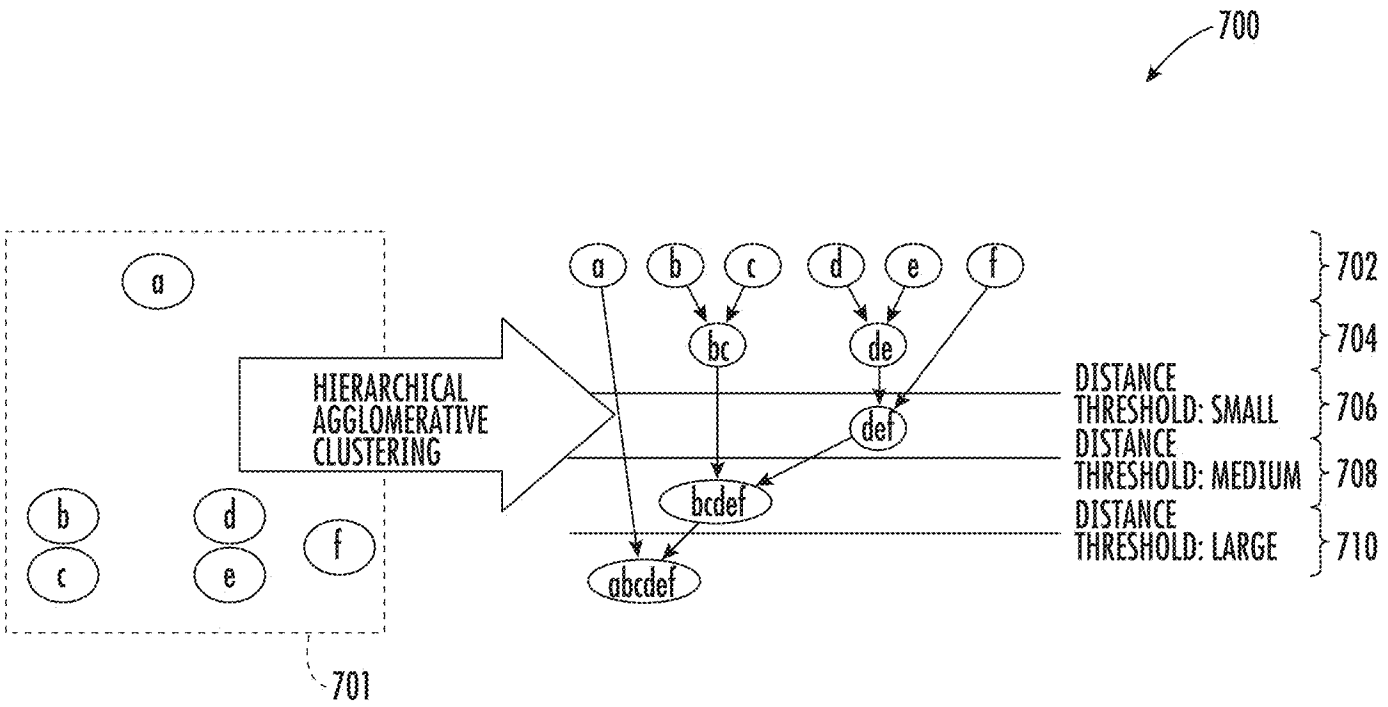
FIG. 7 is a schematic illustration of a hierarchical agglomerative clustering process in accordance with an embodiment of the present disclosure.

FIG. 7 is an illustrative example of hierarchical agglomerative clustering process 700. As shown, elements a-f are representative of individuals located within a monitored space 701. Thus, the illustrative locations of the elements a-f are representative of separation distances between the individual elements a-f within the monitored space 701. The spacing between individual elements may be used to determine groupings. As the hierarchical agglomerative clustering is performed, at the first level 702 of the process, the individual elements are each assigned a separate group, indicated as separate elements a-f. At the second level 704, the closest elements may be grouped together, as shown with b and c grouped and d and e grouped, which is determined from the separation distances of the elements seen on the left of FIG. 7. At the third level 706 of the clustering process, the distances between element f and the group d-e can lead to grouping element f with group d-e, forming group d-e-f. At the fourth level 708, which may occur as the individuals move within the monitored space, the two subgroups d-e-f and b-c may be combined into a larger group, based on proximity of the elements b-f, thus forming group b-c-d-e-f. Finally, depending on the movement of the individuals, element a may be grouped with the rest, such as when all of the individuals have congregated about an elevator door, as shown at the fifth level 710.

The hierarchical agglomerative clustering process is typically based on separation distances between detected objects. In this case, the objects are people located in an elevator lobby area. In some embodiments, the separation distances to determine a relationship between two people (e.g., a cluster) may be set manually, preset into the system, based on testing and/or empirical data, etc. In other embodiments, the separation distances can be learned through machine learning and tracking over time using a given system. Various other mechanisms may be employed without departing from the scope of the present disclosure. In one non-limiting example, a separation distance of about 2-3 meters may be sufficient to "cluster." However, such separation distance may be greater or smaller based on various factors including the amount of volume/space in the lobby, the specific building, culture, or based on other considerations related to group dynamics.

Another feature of the analytics of embodiments of the present disclosure is determination of actions such as group split (one or more people leave a group), group merge (one or more people join a group), group move, group wait, and enter desired destination. These actions may be determined by a variety of techniques such as Markov Logic Networks, Probabilistic Programming, and Deep Networks. The results of action recognition are maintained as probabilities until it is necessary to ground the network (resolve the probabilities into a decision). Recognized actions allows the propagation of assigned destinations and elevators to be propagated to or from a group. Ambiguity, for instance as initial unknown conditions, are represented as equal probabilities across the possible states.

Turning now to FIGS. 8A-8E, schematic plots of a tracking process in accordance with an embodiment of the present disclosure are shown. FIGS. 8A-8E are a progression through time of a plot 800 representing a monitored area 802 that is in proximity to an elevator system (e.g., lobby or elevator waiting area) and representative of the first use case described above. The plot 800 is a 2D (e.g., floor plane) representation, and thus the plot 800 has distance in both the X and Y directions. The elevator system includes a first elevator 804*a*, a second elevator 804*b*, and a third elevator 804*c*. The elevators 804*a-c* may be called by operation or interaction with a first interactive input device 806*a* or a second interactive input device 806*b*. The interactive input devices 806*a-b* may be hall call buttons, kiosks, or other interactive devices that enable calling of at least one of the elevators 804*a-c*. The monitored area 802 is monitored by a first sensor 808*a* and a second sensor 808*b*, with each sensor 808*a-b* having respective sensed area 810*a*, 810*b*.

Figure 8A:
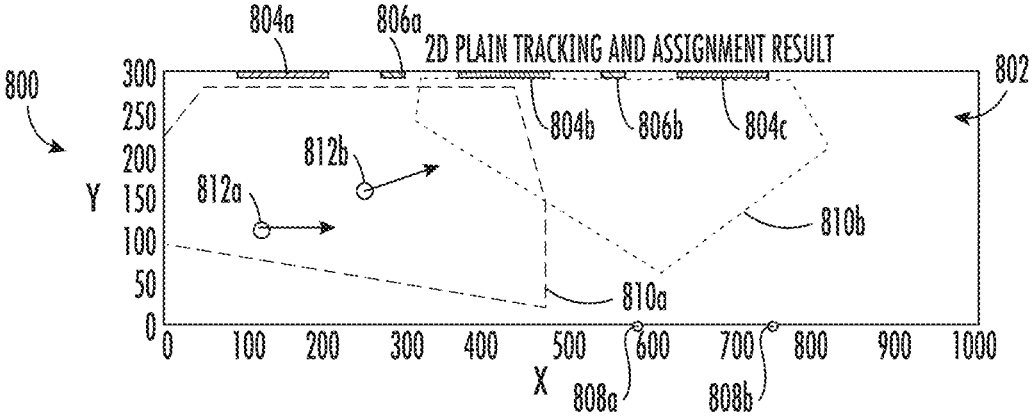
FIG. 8A is a schematic illustration of a step in an elevator scheduling process in accordance with the present disclosure.
Figure 8B:
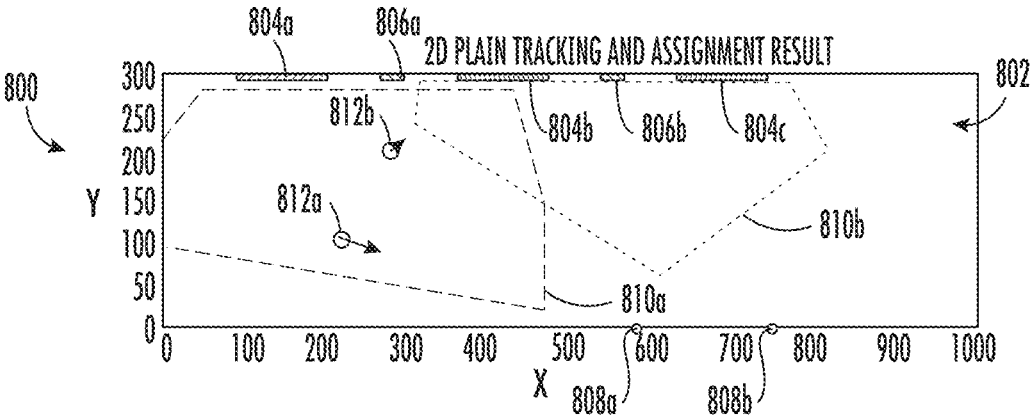
FIG. 8B is a schematic illustration of a step in an elevator scheduling process in accordance with the present disclosure.
Figure 8C:
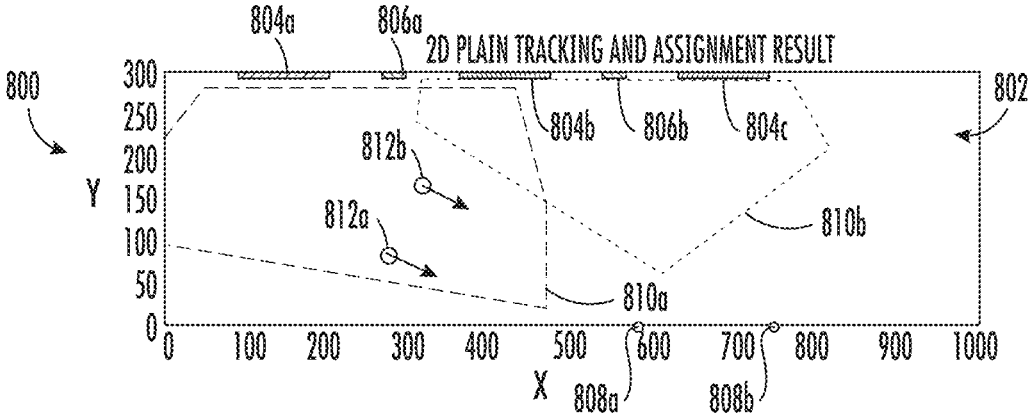
FIG. 8C is a schematic illustration of a step in an elevator scheduling process in accordance with the present disclosure.
Figure 8D:
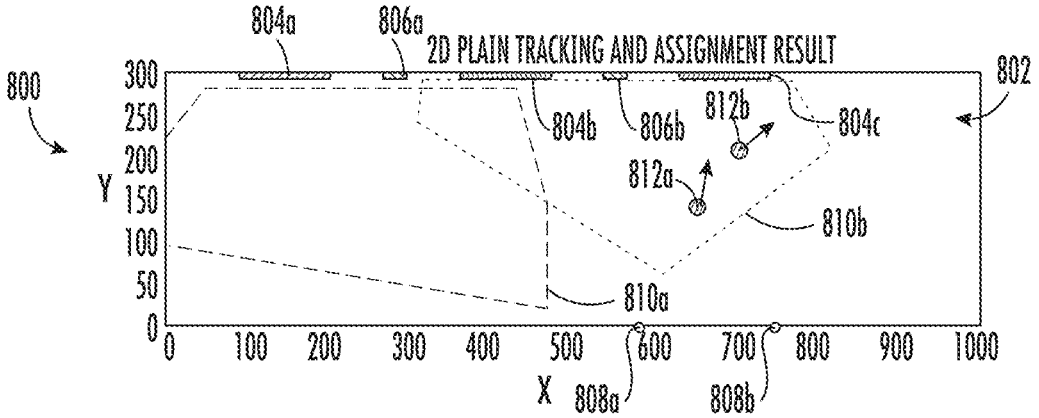
FIG. 8D is a schematic illustration of a step in an elevator scheduling process in accordance with the present disclosure.
Figure 8E:
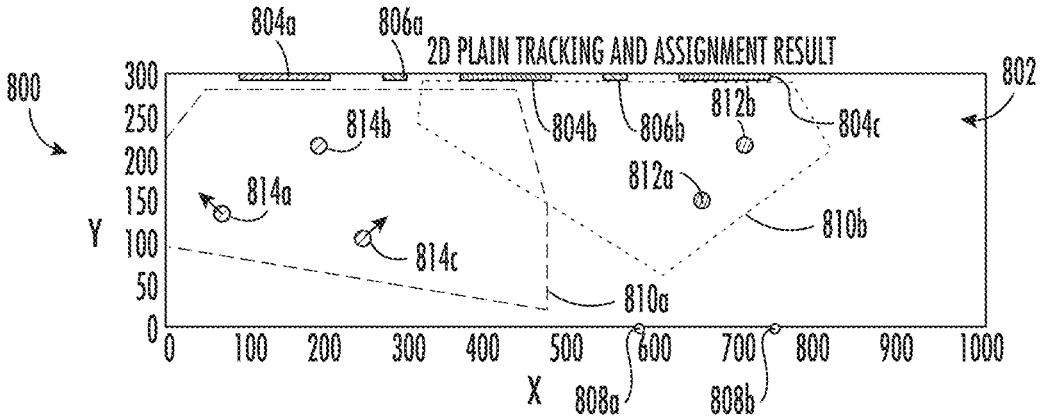
FIG. 8E is a schematic illustration of a step in an elevator scheduling process in accordance with the present disclosure.

As shown in FIG. 8A, a group of two people 812*a*, 812*b* enter the view or sensed area 810*a* of the first sensor 808*a*. The two people 812*a-b* are tracked and represented by dots and may be assigned a tracker ID label, such as an element number or color to enable association within the processing (e.g., for elevator assignments). In FIG. 8B, one person 812*b* leaves the group and use the first interactive input device 806*a* to input an elevator request. The second person 812*b*, who enters an elevator request at the first interactive input device 806*a* is assigned with floor information and possibly elevator information associated with one of the elevators 804*a-c*. In this example, the second person 812*b* is assigned the third elevator 804*c*. The other person 812*a* is waiting in the monitored area 802 without assignment and the location of this first person 812*a* is far from the person entering the call, so no floor assignment is generated. However, when the two people 812*a*, 812*b* are walking close to each other, as shown in FIG. 8C, they are clustered again into one group and the floor assignment from the second person 812*b* is propagated to the unassigned person 812*a*. When the two persons 812*a-b* walk toward the assigned elevator 804*c* and wait in front of the elevator door, as shown in FIG. 8D, the data points within the system may be changed to be associated with the appropriate elevator. In some embodiments, the elevator may not be assigned, but only the destination may be tracked. In such a case, if the second person 812*b* moves to a particular elevator 804*a-c*, once the person waits, the assignment and change of data points may occur. FIG. 8E illustrates a final processing result for this scenario when two groups of people (812*a-b*, 814*a-c*) use the interactive input devices 806*a-b* and wait separately in front of two different doors of the elevators 804*a-c*. In this final scenario, a first group 812*a-b* is assigned to the third elevator 804*c* and a second group 814*a-c* is assigned to the first elevator 804*a*.

As described previously, in FIG. 8B, one person 812*b* leaves the group 812*a-b* and uses the first interactive input device 806*a* to input an elevator request. If the same person 812*b* immediately makes an additional request at the first interactive input device 806*a* (or at a different interactive input device), it the system may immediately cancel the first entered request or, in some embodiments, prompt the person 812*b* to select one request to remain valid. Thus, a single entry may be recorded and entered for a single person (and group). Further, if the group 812*a-b* is established or identified and assigned a destination, and the other person 812*a* enters a destination, the system may be configured to request confirmation of such second entry to confirm the destinations of the two persons 812*a*, 812*b* are different. It is noted that without tracking as provided herein, it may not be known if a subsequent request from the same person 812*b* at a different input device, e.g., 806*b*, is made. However, with embodiment of the present disclosure, tracking of a subsequent request may be unambiguously associated with the person making the request and enables canceling or prompting to resolve the multiple requests from the same person (or group).

When a second input or multiple subsequent inputs are detected and associated with a single person or group of persons, the system may take one or more corrective actions. For example, in some embodiments a corrective action may be to cancel all prior inputs/entries from that person, and only accept the final input received. In other embodiments, the corrective action may be to display a prompt and require the person to clarify or specify a desired input. Other corrective actions may be performed without departing from the scope of the present disclosure. For example, in some embodiments, the corrective action may include a visual or audio notification alerting the user to the duplicate input.

Figure 9A:
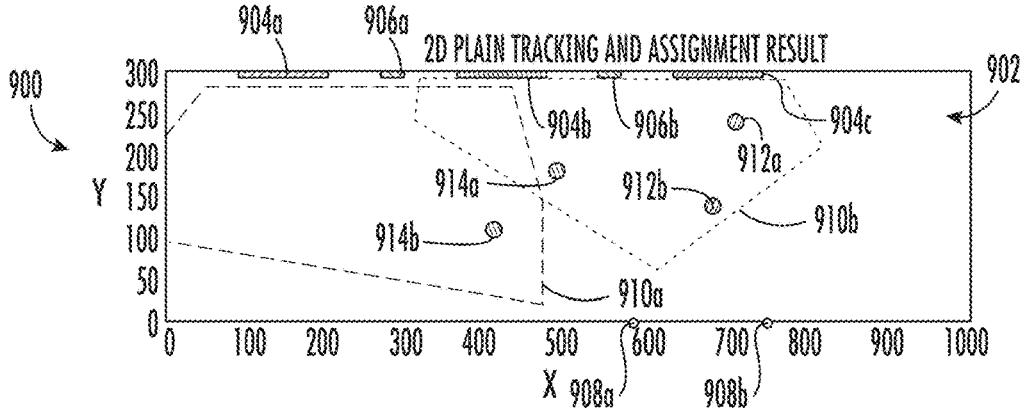
FIG. 9A is a schematic illustration of a step in an elevator scheduling process in accordance with the present disclosure.
Figure 9B:
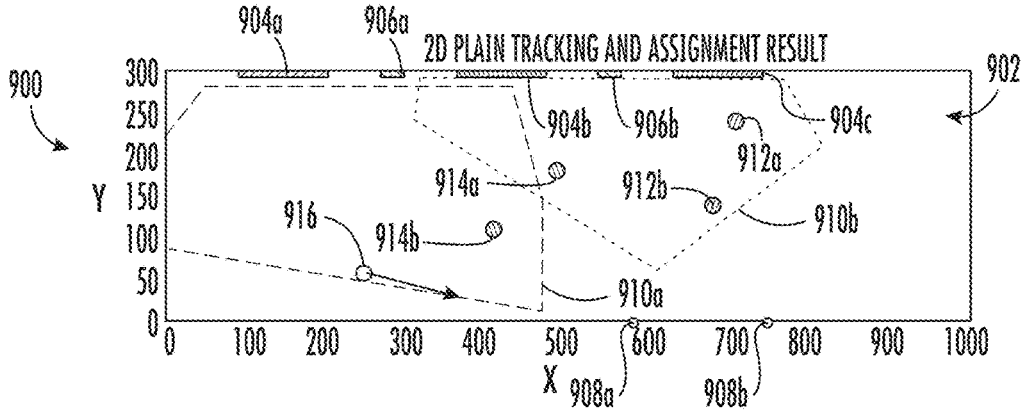
FIG. 9B is a schematic illustration of a step in an elevator scheduling process in accordance with the present disclosure.
Figure 9C:
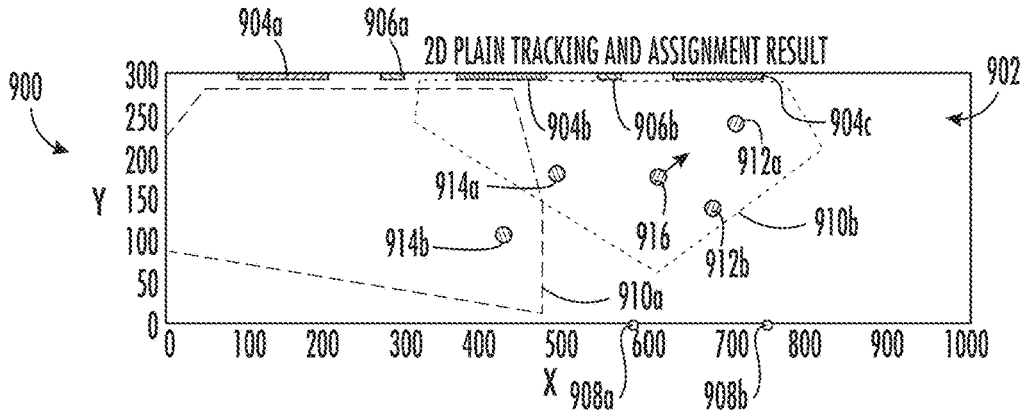
FIG. 9C is a schematic illustration of a step in an elevator scheduling process in accordance with the present disclosure.

Turning now to FIGS. 9A-9C, schematic plots of a tracking process in accordance with an embodiment of the present disclosure are shown. FIGS. 9A-9C are a progression through time of a plot 900 representing a monitored area 902 that is in proximity to an elevator system (e.g., lobby or elevator waiting area) and representative of the second use case described above. The plot 900 is a 2D (e.g., floor plane) representation, and thus the plot 900 has distance in both the X and Y directions. The elevator system includes a first elevator 904*a*, a second elevator 904*b*, and a third elevator 904*c*. The elevators 904*a-c* may be called by operation or interaction with a first interactive input device 906*a* or a second interactive input device 906*b*. The interactive input devices 906*a-b* may be hall call buttons, kiosks, or other interactive devices that enable calling of at least one of the elevators 904*a-c*. The monitored area 902 is monitored by a first sensor 908*a* and a second sensor 908*b*, with each sensor 908*a-b* having respective sensed area 910*a*, 910*b*.

As shown in FIG. 9A, a first group 912*a-b* of two people and a second group 914*a-b* of two people, are illustratively shown in the monitored area 902 and proximate the elevators 904*a-c*. In this scenario, the two groups 912*a-b*, 914*a-b* have already been assigned specific elevators, and are grouped as such. For example, at least one member of each group 912*a-b*, 914*a-b* uses one of the interactive input devices 906*a-b* to register an elevator call. Thus, as shown, the groups 912*a-b*, 914*a-b* are waiting in front of respective elevator doors of the second and third elevators 904*b*, 904*c*.

As shown in FIG. 9B, an additional person 916 enters the monitored area 902. The additional person 916 does not use one of the interactive input devices 906*a-b* to make an elevator call. Instead, the additional person walks directly toward the first group 912*a-b* and interacts with the members of the first group 912*a-b*. When the additional person 916 enters the monitored area 902, the additional person 916 is tracked and represented by an "unknown destination" data point because the additional person is not clustered into any group already in the monitored area 902.

However, as shown in FIG. 9C, once the additional person 916 joins the first group 912*a-b* that is waiting for the third elevator 904*c*, the assignment from the members of the first group 912*a-b* may be propagated to the joining person. That is, the assignment of the other members of the first group 912*a-b* may be propagated to any other persons that join the group, including the additional person 916 shown in FIGS. 9B-9C. The additional person 916 may be represented by a matching data set indicating the same elevator and floor assignment information as the other members of the first group 912*a-b*.

It will be appreciated that the illustrative plots of FIGS. 8A-8E and FIGS. 9A-9C are merely schematic and the illustrative separation distances and groupings are provided for example and explanatory purposes. The separation distances between any two (or more) people that are classified as a group may be based on the specific system, space constraints, culture, etc. Further, a separation distance as used herein may be a threshold distance for classifying as a group. For example, two people that work together may stand or interact with a minimum separation distance that may be set as the threshold separation distance. However, two people that are more intimately familiar may be separated by significantly less distance, such as a child and parent that are holding hands. Accordingly, the separation distance is not a uniform or fixed value, but rather represents a threshold distance that may be used to classify two or more people as associated with a single group.

In accordance with embodiments of the present disclosure, group dynamics are employed to allow for the propagation of elevator scheduling assignments to persons that have not directly interacted with the system. That is, persons that piggyback off of other individual or group inputs may be accounted for by elevator scheduling systems. As such, a single request or multiple similar requests (and assignments) may be propagated to previously "unknown assignment" users of the elevator system.

Thus, advantageously, the elevator control system (e.g., scheduling controller) may be provided or obtain more accurate information regarding usage and number of passengers within elevator cars. In some embodiments, additional information may be included in the assignment process. For example, if the number of current passengers in a given elevator car is known, the group scheduling for passengers in a lobby or waiting area may account for the amount of room available within the elevator car. Accordingly, a group that has two inputs made (indicating two passengers) may traditionally be assigned to a car that has room for two or three additional passengers. However, such system may not account for others that are in a group with the first two passengers. When embodiments of the present disclosure are employed, the additional persons that did not enter an input request may be accounted for, and thus an appropriate elevator car with adequate space may be provided to the landing where the call request is made.

Although the group dynamic analysis of some embodiments may be preprogrammed, in some embodiments, the analytics may be machine learned (or a combination thereof). For example, the tracking algorithm for one or more people may be machine learned and updated to account for human interactions, which may be unpredictable and/or variable. Further, monitoring how groups interact, such as facing direction, gestures, vocalization, movement, etc. may be used to aid in group analysis. Accordingly, when an individual is tracked, an appropriate assignment for an elevator call may be assigned to a given individual. It is noted that in some embodiments, the assignment may occur immediately, based on tracking and group analysis. However, in other embodiments, the assignment to an unknown destination person may not be assigned until the last moment, when it may be definitely or at least substantially probable that a given person will be entering a given elevator car. Further, in some embodiments, even if the destination cannot be inferred, an elevator car assignment may be useful to be known or inferred. In such instances, the highest possible destination of a given group may be assigned to the unknown passenger, to account for numbers of persons located within an elevator car during travel.

Advantageously, embodiments of the present disclosure provide for multiple, simultaneous object tracking across multiple depth sensors employing spatial and temporal consistency. Accordingly, multiple users of an elevator system may be tracked and accounted for in terms of elevator scheduling, even if such users do not interact with an interactive input device (e.g., kiosk, hall call panel, mobile device, key card, etc.). Further, embodiments provided herein provide for the use of multi-perspective shape models for improved tracking accuracy of depth sensors. Moreover, intent inferences may be propagated from individuals to groups and/or from groups to individuals, thus making elevator scheduling more efficient. Furthermore, by combining sensor analytics with destination entry systems, improved controller and elevator scheduling performance may be achieved.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An elevator system, comprising:

an elevator car operable within an elevator shaft and moveable between a plurality of landings;

an elevator controller operable to control movement and position of the elevator car within the elevator shaft; and an elevator scheduling system comprising:

at least one sensor configured to monitor a monitored area;

at least one interactive input device configured to receive input from at least one user; and a scheduling controller coupled to the at least one sensor and the at least one interactive input device, the scheduling controller configured to:

receive inputs from the at least one interactive input device;

track one or more people located within the monitored area;

assign elevator assignments to the one or more people based on at least one of the inputs from the at least one interactive input device and a grouping algorithm based on the tracking of the one or more people; and schedule operation of the elevator car based on the elevator assignments.

2. The elevator system according to claim 1, wherein the at least one interactive input device comprises at least one of a kiosk, a hall call panel, a mobile device, and a key card.

3. The elevator system according to claim 1, wherein the at least one sensor comprises a 3D depth sensor.

4. The elevator system according to claim 1, wherein the scheduling controller and the elevator controller are part of the same computing system.

5. The elevator system according to claim 1, wherein the scheduling controller tracks an individual that does not interact with the at least one interactive input device and assigns the individual an elevator assignment based on the grouping algorithm.

6. The elevator system according to claim 1, wherein the scheduling controller tracks an individual that interacts with the at least one interactive input device and assigns the individual an elevator assignment based on input at the at least one interactive input device.

7. The elevator system according to claim 6, wherein the input from the individual is propagated to at least one additional person based on the grouping algorithm.

8. The elevator system according to claim 1, wherein the grouping algorithm is machine learned.

9. The elevator system according to claim 1, further comprising at least one additional elevator car, wherein the elevator assignments indicate which elevator car each person is assigned to.

10. The elevator system according to claim 1, wherein the monitored area is an elevator lobby.

11. A method for controlling an elevator system, the method comprising:

receiving inputs from at least one interactive input device, wherein the inputs include elevator call requests;

tracking one or more people located within a monitored area using at least one sensor;

assigning elevator assignments to the one or more people based on at least one of the inputs from the at least one interactive input device and a grouping algorithm based on the tracking of the one or more people; and scheduling operation of at least one elevator car based on the elevator assignments.

12. The method according to claim 11, wherein the at least one interactive input device comprises at least one of a kiosk, a hall call panel, a mobile device, and a key card.

13. The method according to claim 11, wherein the at least one sensor comprises a 3D depth sensor.

14. The method according to claim 11, wherein the scheduling is performed at a scheduling controller that is part of an elevator controller.

15. The method according to claim 11, further comprising tracking an individual that does not interact with the at least one interactive input device and assigning the individual an elevator assignment based on the grouping algorithm.

16. The method according to claim 11, further comprising tracking an individual that interacts with the at least one interactive input device and assigning the individual an elevator assignment based on input at the at least one interactive input device.

17. The method according to claim 16, further comprising propagating the input from the individual to at least one additional person based on the grouping algorithm.

18. The method according to claim 11, further comprising machine learning the grouping algorithm.

19. The method according to claim 11, further comprising at least one additional elevator car, wherein the elevator assignments indicate which elevator car each person is assigned to.

20. The method according to claim 11, further comprising:

determining if an input received at an interactive input device is a second input from at least one person of a group of one or more persons; and taking corrective action regarding the second input.

* * * * *